US006584983B1

(12) United States Patent
Nicot et al.

(10) Patent No.: US 6,584,983 B1
(45) Date of Patent: Jul. 1, 2003

(54) FLEXIBLE ANTISLIP ELEMENT AND WIG

(75) Inventors: Jérôme Nicot, Quimper (FR); Nicole Denelle, Boulogne Billancourt (FR)

(73) Assignee: NJ Diffusion S.A.R.L. (Societe A Responsabilite Limitee), Paris (FR)

( * ) Notice: Subject to any disclaimer, the term of this patent is extended or adjusted under 35 U.S.C. 154(b) by 0 days.

(21) Appl. No.: 09/622,905

(22) PCT Filed: Dec. 10, 1998

(86) PCT No.: PCT/FR98/02689

§ 371 (c)(1),
(2), (4) Date: Sep. 5, 2000

(87) PCT Pub. No.: WO99/44452

PCT Pub. Date: Sep. 10, 1999

(30) Foreign Application Priority Data

Mar. 6, 1998 (FR) ..... 98 03015

(51) Int. Cl.[7] ..... A41G 3/00
(52) U.S. Cl. ..... 132/53; 2/174; 2/200.1
(58) Field of Search ..... 132/53, 56, 201; 224/901; 427/208; 2/200.1, 200.2, 209.13, 174, 171

(56) References Cited

U.S. PATENT DOCUMENTS 851,384 A * 4/1907 Sleicher ..... 132/53
2,850,023 A * 9/1958 Taylor ..... 132/54
3,618,754 A * 11/1971 Hoey ..... 206/411
3,710,452 A * 1/1973 Hamrick ..... 132/53
3,724,470 A * 4/1973 Wilson ..... 132/212
4,463,083 A * 7/1984 Kitajima et al. ..... 430/273
4,496,624 A * 1/1985 McCartney ..... 428/288
4,681,934 A * 7/1987 Shibanai et al. ..... 536/46
4,825,886 A * 5/1989 Allen ..... 132/54
5,630,230 A * 5/1997 Fujino et al. ..... 2/200.1
5,741,336 A * 4/1998 Fraser ..... 623/15
5,806,535 A * 9/1998 Becker ..... 132/54
6,170,491 B1 * 1/2001 Maekawa ..... 132/201

* cited by examiner

*Primary Examiner*—Kevin Shaver
*Assistant Examiner*—David C. Comstock
(74) *Attorney, Agent, or Firm*—Greenblum & Bernstein, P.L.C.

(57) ABSTRACT

Wig or hairpiece having a flexible antislip system (2) which allows a user to non-adhesively and removably attach the wig or hairpiece to the user's head. The wig or hairpiece includes a drawable fabric (3) impregnated with a thin drawable film (4). The thin drawable film is arranged on a surface of the drawable fabric which contacts the skin of the user's head when the wig or hairpiece is positioned on the user's head. The thin drawable film prevents the wig or hairpiece from slipping on the user's head when positioned on the user's head. The thin drawable film has at least one of a non-sticky and a non-gummy antislip surface at temperatures lower than a softening temperature of the thin drawable film.

20 Claims, 1 Drawing Sheet

FLEXIBLE ANTISLIP ELEMENT AND WIG

CROSS-REFERENCE TO RELATED APPLICATIONS

The present application is a National Stage Application of International Application No. PCT/FR98/02689, filed Dec. 10, 1998. Further, the present application claims priority under 35 U.S.C. §119 of French Patent Application No. 98/03015 filed on Mar. 6, 1998.

BACKGROUND OF THE INVENTION

1. Field of the Invention

The present invention relates to a flexible element having a low slip coefficient or antislip element that can be applied to wigs so as to contribute in holding them in the desired position on the user's head, the invention applying, in this case, to all types of artificial hair, regardless of their end-use (wigs, hairpieces, hair replacements), and even to other types of hairstyles.

The invention also relates to the wigs provided with such flexible antislip or antislide elements.

2. Description of Background and Relevant Information

It is known that hairpieces, wigs and the like include an inner support, most often constituted by a net of a particular type, on which natural or artificial hair is fixed, the inner support being provided with means for fixing the wig on the user's head. These fixing means are of very diverse types and should, in theory, meet the following requirements:

- they should enable an easy and quick positioning of the wig on a user's head;
- they should prevent it from slipping into an askew position; and
- they should allow for its easy and quasi-instant removal.

However, the current means for fixing wigs do not resolve the aforementioned problems in a very satisfactory manner.

For example, the major drawback of wigs or hairpieces is their propensity to slip on the user's head, which is noted regardless of the assembly base used to manufacture them, namely, on mechanical assembly (band assembly), or hand-implanted (netting) in particular. This risk is increased for bald or hairless persons having a larger surface with a complex relief to be covered. The fact that the conventional wigs or hairpieces are not antislip naturally causes numerous drawbacks for the user.

Various techniques for fixing such wigs on the wearer's head have been hitherto proposed, to ensure their holding in position, for example by using hooking elements (clip, comb, pins, . . . ) which catch natural hair locks, or by adhesion by means of indefinite adhesives.

The mechanical means for fixing wigs are difficult to use; specifically, they do not make it possible to ensure that they remain in the correct position, or do not permit removing them easily and quickly; and they are uncomfortable when they do not have traumatic effects on the wearer's head. Therefore, they do not seem to represent an alternative, if not for the future, at least for mass-distribution.

The positioning of the wigs by means of an adhesive, such as described in the document WO 93/03635 for example, requires applying glue on the surfaces intended to come in contact with one another on the wig and the scalp, by apportioning the quantity needed for this operation, which is delicate and prolongs the wig set-up time.

The head of the person on which the wig is to be positioned must be cleaned beforehand with a special solution (alcohol) to ensure correct bonding. This type of bonding lasts 3–6 weeks, as the case may be, and, after being adhered directly on the scalp, the wig can be removed only with many difficulties, even by cutting the hair to which it was adhered, in order, for example, to reposition the wig, which is very unpleasant and bothersome. Furthermore, the gluing can cause allergy and itch phenomena. The residual adhesive on the skull must be removed by means of solvents or abrasives.

None of the aforementioned means is entirely satisfactory, with respect to both the positioning speed and the hold of the wig on the head.

SUMMARY OF THE INVENTION

The invention therefore provides for a device which aims to resolve the various problems arising from the use of hairpieces.

According to the invention, there is provided a wig whose inner support or cap is provided internally with flexible antislip pieces fixed on its inner surface and constituted by a drawable fabric impregnated with a substance forming a thin drawable film on at least its surface adapted to come in contact with the skin of a user's skull, this thin drawable film having a non-sticky or non-gummy antislip surface at temperatures lower than its softening temperature, for example, room temperature, after the fabric has been impregnated and dried.

According to another characteristic arrangement, the fabric constituting the core of the flexible antislip elements and/or the thin film of adhesive substance coating at least one of the surfaces of said core, is or are provided with an elastic drawing capacity.

According to another characteristic arrangement, the antislip film is constituted by a mixture of two glues selected from the class of polyurethanes and whose one or more characteristics hereinafter are different:

dry-solid extract viscosity

100% modulus (kg/cm$^2$)

tensile force (kg/cm$^2$)

elongation %

According to another characteristic arrangement, the two polyurethane glues have the following physical properties: the first:

| | |
|---|---|
| dry-solid extract %: | 30.0 |
| viscosity (cps/10° C.): | 70 000 |
| 100% modulus (kg/cm$^2$): | 28 |
| tensile force (kg/cm$^2$): | 430 |
| elongation %: | 550 |

the second:

| | |
|---|---|
| dry-solid extract %: | 39.0 |
| viscosity (cps/10° C.): | 75 000 |
| 100% modulus (kg/cm$^2$): | 93 |
| tensile force (kg/cm$^2$): | 560 |
| elongation %: | 440 |

According to another characteristic arrangement, the antislip pieces are arranged in the following zones of the cap-shaped inner support of the wig, with respect to the person's skull:

frontal zone vertex zone temporal zones occipital zone

According to another characteristic arrangement of the antislip pieces, obtained in the form of fastening lugs, are arranged in the temporal zones.

The invention also provides for a wig or hairpiece having a flexible antislip system which allows a user to non-adhesively and removably attach the wig or hairpiece to the user's head, comprising a drawable fabric impregnated with a thin drawable film, the thin drawable film being arranged on a surface of the drawable fabric which contacts the skin of the user's head when the wig or hairpiece is positioned on the user's head, and the thin drawable film preventing the wig or hairpiece from slipping on the user's head when positioned on the user's head, wherein the thin drawable film has at least one of a non-sticky and a non-gummy antislip surface at temperatures lower than a softening temperature of the thin drawable film.

The thin drawable film may have at least one of a non-sticky and a non-gummy antislip surface at temperatures lower than room temperature. The thin drawable film may comprise at least one antislip strip. At least one of the drawable fabric and the thin drawable film may be at least one of elastic and elastically deformable. The thin drawable film may comprise a mixture of two glues selected from a class of polyurethanes. The two glues may have at least one different characteristic from each other, the at least one characteristic relating to at least one of dry-solid extract, viscosity, 100% modulus (kg/cm$^2$), tensile force (kg/cm$^2$), elongation %. The two glues may comprise a first glue and a second glue, the first glue having the following physical properties: dry-solid extract of 30.0%; viscosity of 70 000 cps/10° C.; 00% modulus 28 kg/cm$^2$; tensile force of 430 kg/cm$^2$; elongation of 550%; and the second glue having the following physical properties: dry-solid extract of 39.0%; viscosity of 75 000 cps/10° C.; 100% modulus of 93 kg/cm$^2$; tensile force of 560 kg/cm$^2$; and elongation of 440%. The mixture may have a proportion of nine parts first glue to one part second glue. The drawable fabric may comprise a woven core. The thin drawable film may have a thickness in the range of between 0.05 mm and 0. 1 5 mm. The thin drawable film may one of partially coat and totally coat the surface of the drawable fabric.

The invention also provides for a wig or hairpiece having a flexible antislip system which allows a user to non-adhesively and removably attach the wig or hairpiece to the user's head, comprising an elastically deformable fabric core impregnated with a plurality of thin flexible film strips, each of the thin flexible film strips being arranged on a surface of the fabric core which contacts the skin of the user's head when the wig or hairpiece is positioned on the user's head, and each of the thin flexible film strips preventing the wig or hairpiece from slipping on the user's head when positioned on the user's head, wherein each of the thin flexible film strips has at least one of a non-sticky and a non-gummy antislip surface at temperatures lower than a softening temperature of the thin flexible film strips.

Each of the thin flexible film strips may comprise a flexible antislip strip which prevents the wig or hairpiece from slipping on the user's head when positioned on the user's head. At least one of the flexible antislip strips may be arranged along a contour of the elastically deformable fabric core. The flexible antislip strips may be arranged in one or more of the following zones of the elastically deformable fabric core: in a frontal zone, in a vertex zone; in at least one temporal zone, and in an occipital zone. The wig or hairpiece may further comprise at least one fastening device. The at least one fastening device may comprise a flexible antislip band which is arranged in a temporal zone of the elastically deformable fabric core. Each of the thin flexible film strips may have a thickness in the range of between 0.05 mm and 0.15 mm.

The invention also provides for a wig or hairpiece having a flexible antislip system which allows a user to non-adhesively and removably attach the wig or hairpiece to the user's head, comprising a cap made of a fabric impregnated with a plurality of thin flexible antislip film strips, each of the thin flexible antislip film strips being arranged on an inner surface of the cap which contacts the skin of a user's head when the wig or hairpiece is positioned on the user's head, and each of the thin flexible antislip film strips preventing the wig or hairpiece from slipping on the user's head when positioned on the user's head, wherein each of the thin flexible antislip film strips has at least one of a non-sticky and a non-gummy antislip surface at temperatures lower than a softening temperature of the thin drawable film strips.

Each of the thin flexible antislip film strips may have a thickness in the range of between 0.05 mm and 0.15 mm.

Due to the antislip pieces with which the wig according to the invention is provided, the wig has the following advantages:

- it can be quickly and easily positioned by a user, without requiring a specialist;
- it holds well on the head, without causing any sensation of discomfort; and
- it can be easily and instantly removed without causing any unpleasant effect (no "hair-pulling" effect).

BRIEF DESCRIPTION OF THE DRAWINGS

The above objects, characteristics and other advantages, will become more apparent from the following description and annexed drawing, in which.

DETAILED DESCRIPTION OF THE INVENTION

Figure 1:
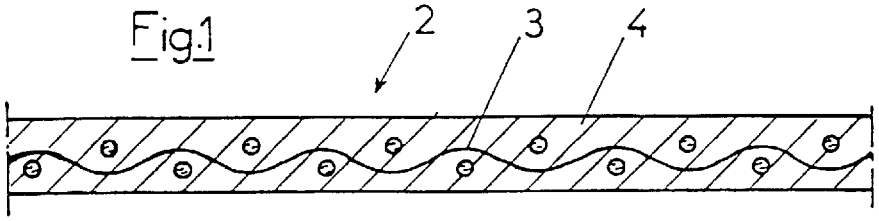
FIG. 1 shows an enlarged, schematic cross-sectional view of a flexible antislip element according to the invention.

Reference is made to the drawing to describe a non-limiting example of an embodiment of a flexible antislip element and of a wig according to the invention.

In a known fashion, the wig according to the invention includes:

- a cap-shaped support 1 that can be constituted by a sort of net;
- natural or artificial hair (not shown) fixed on the outer surface of this support.

According to a first characteristic arrangement, the inner surface of the cap-shaped support 1 is provided with antislip pieces 2A, 2B, 2C, 2D, constituted by an elastic fabric 3 impregnated with a glue 4 forming a film on at least its surface adapted to come in contact with the skin of a person's skull, this film having a drawing capacity and a non-sticky or non-gummy contact surface at temperatures lower than its softening temperature, for example, room temperature, after impregnation and drying.

The drawable fabric that constitutes the core 3 of the antislip pieces 2A, 2B, 2C, 2D, can be a woven, knitted, or non,woven fabric provided with a drawing capacity. This fabric can be made of a variety of vegetable, animal, artificial or synthetic textiles having the required qualities.

For example, it can be advantageously constituted by a thread-woven band having a relatively high percentage of apertures.

The fabric core 3 is impregnated with a glue 4 forming a film on at least its surface adapted to come in contact with the skin of a person's skull, this film having a drawing capacity. It also has a non-sticky or non-gummy contact surface at temperatures lower than its softening temperature, for example, room temperature, after the fabric has been impregnated and dried.

According to another characteristic arrangement of the invention, the fabric constituting the core 3 of the antislip pieces and/or the film of glue 4 are provided with an elastic deformation capacity.

The film of glue 4 can be made of any adhesive having the aforementioned characteristics and selected from the class of natural products or from that of synthetic resins such as thermosetting resins (acrylics, anaerobics, epoxides, unsaturated polyesters, polyurethanes, etc.), for example.

Regardless of the type of adhesive substance for impregnating the fabric constituting the core 3 of the antislip element 2, the film formed on one of the surfaces of this core has a thickness that is reduced to several hundredths of a millimeter, for example, a thickness on the order of 0.05 mm–015 mm.

Advantageously, the adhesive film 4, according to another characteristic arrangement of the invention, is constituted by a mixture of two glues selected from the class of polyurethanes, and whose one or more characteristics hereinafter are different:

dry-solid extract;

viscosity;

100% modulus (kg/cm$^2$);

tensile force (kg/cm$^2$); and elongation %.

Interestingly, these glues are those referenced by the respective codes S1070 (HI-THANE) and S1090 (HI-THANE) and having the characteristics that are disclosed in the following tables:

| S-1070 (HI-THANE) Batch No. 21 229 | |
|---|---|
| Color (APHA) | 30 |
| Dry-solid extract % | 30.0 |
| Viscosity (cps/10° C.) | 70 000 |
| 100% modulus (kg/cm$^2$) | 28 |
| Tensile force (kg/cm$^2$) | 430 |
| Elongation % | 550 |
| Solvent | DMF, MEK |
| Diluent | DMF, MEK |
| Film | 0.052 mm |

| S-1090 (HI-THANE) Batch No. 30 121 | |
|---|---|
| Color (APHA) | 10 |
| Dry-solid extract % | 39.0 |
| Viscosity (cps/10° C.) | 75 000 |
| 100% modulus (kg/cm$^2$) | 93 |
| Tensile force (kg/cm$^2$) | 560 |
| Elongation % | 440 |

-continued

| | |
|---|---|
| Solvent | DMF, MEK |
| Diluent | DMF, MEK |
| Film | 0.051 mm |

Advantageously, the two above adhesives are mixed in the following proportion:

(I) S-1070/(II) S-1090=9/1

This mixture is spread, by any known method or equipment, on the fabric constituting the core 3 of the antislip pieces 2, when the latter is in the non-stretched state.

The characteristics of this mixture of glue are such that at room temperature, the surfaces of the antislip pieces 2A–2D in contact with the skin are not sticky, while being slightly self-adhesive and, in any case, adapted to prevent the wig from slipping on the wearer's head.

Figure 2:
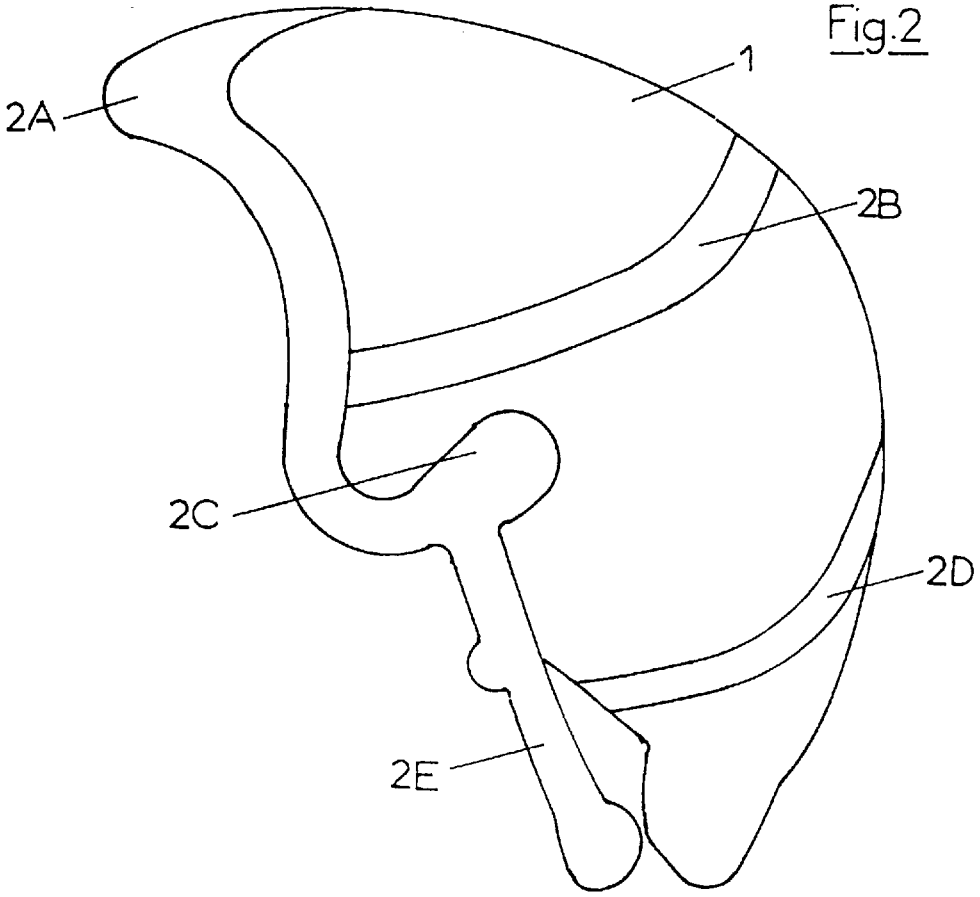
FIG. 2 shows a schematic, perspective view of the wrong side of the cap-shaped support of a wig, provided with flexible antislip elements.

The flexible antislip element 2 thus structured can be manufactured in the form of bands to be cut, pellets, etc. It is secured by any known manner (adhesion, hand- or machine-sewn, etc.) on the inner surface of the cap of the wig (or "inner portion of the wig or hairpiece"), regardless of the mounting base used for the cap (namely mechanical, implanted by hand, microfilament, monofilament), so as to be uniformly (FIG. 2) or randomly spaced. This addition to the woven material makes it possible to adapt the concept on any support, pre-existing wig, hairpiece, etc. The coating of the inner surface of the cap with these antislip elements 2 can be partial or total. It can be sufficient to arrange vertical or horizontal bands of antislip elements 2 along the entire internal contour of the inner support or cap.

However, according to a characteristic arrangement of the invention, flexible antislip pieces 2A–2D are arranged in the following zones of the cap-shaped inner support 1, with respect to the zones of person's skull (FIG. 2):

frontal zone (piece 2A);

vertex zone (piece 2B);

temporal zones (pieces 2C); and occipital zone (piece 2D).

After tests, it has been found that the aforementioned locations conform to the skull configuration and make it possible to obtain a very good hold of the wig on the head.

Advantageously, fastening lugs or bands 2E constituted by flexible antislip elements 2 can be arranged in the temporal zones, and, for example, in the rear portion thereof These fastening bands can be mounted with an ability to slide in a-keeper, in a known manner, the surface of the free end opposite their antislip surface being provided with a self-gripping strip.

Furthermore, to increase the comfort of the wigs, soft elements are added. The latter are constituted by bands or pieces of soft felt, and/or silk, gauze, cotton, etc., or of any other material capable of fulfilling this function. The latter have reduced dimensions, a few centimeters long, about one centimeter wide, and a maximum thickness of 1 mm. They are sewn within the wig, all around the cap and/or in a scattered manner thereon. Preferably, these soft rectangular bands are staggered within the wig, along the frontal edge and within the cap. This added comfort is very appreciable for completely bald people to whom direct contact of the skin with the cap of the wig can cause discomfort, even irritation. The wig or hairpiece provided with such soft elements is more particularly adapted to preserve sensitive or irritated scalps.

What is claimed is:

1. A wig or hairpiece having a flexible antislip system which allows a user to non-adhesively and removably attach the wig or hairpiece to a user's head, comprising:

a drawable fabric impregnated with a thin drawable film;

the thin drawable film being arranged on a surface of the drawable fabric which contacts the skin on a user's head when the wig or hairpiece is positioned on a user's head; and the thin drawable film preventing the wig or hairpiece from slipping on a user's head when positioned on a user's head, wherein the thin drawable film has at least one of a non-sticky and a non-gummy antislip surface at temperatures lower than a softening temperature of the thin drawable film.

2. The wig or hairpiece of claim 1, wherein the thin drawable film has at least one of a non-sticky and a non-gummy antislip surface at temperatures lower than room temperature.

3. The wig or hairpiece of claim 1, wherein the thin drawable film comprises at least one antislip strip.

4. The wig or hairpiece of claim 1, wherein at least one of the drawable fabric and the thin drawable film is at least one of elastic and elastically deformable.

5. The wig or hairpiece of claim 1, wherein the thin drawable film comprises a mixture of two glues selected from a class of polyurethanes.

6. The wig or hairpiece of claim 5, wherein the two glues have at least one different characteristic from each other, the at least one characteristic relating to at least one of dry-solid extract, viscosity, 100% modulus (kg/cm$^2$), tensile force (kg/cm$^2$), and elongation %.

7. The wig or hairpiece of claim 5, wherein the two glues comprise a first glue and a second glue, the first glue having the following physical properties:
dry-solid extract of 30.0%;
viscosity of 70 000 cps/10° C.;
100% modulus 28 kg/cm$^2$;
tensile force of 430 kg/cm$^2$;
elongation of 550%; and the second glue having the following physical properties:
dry-solid extract of 39.0%;
viscosity of 75 000 cps/10° C.;
100% modulus of 93 kg/cm$^2$;
tensile force of 560 kg/cm$^2$; and
elongation of 440%.

8. The wig or hairpiece of claim 7, wherein the mixture has a proportion of nine parts first glue to one part second glue.

9. The wig or hairpiece of claim 1, wherein the drawable fabric comprises a woven core.

10. The wig or hairpiece of claim 1, wherein the thin drawable film has a thickness in the range of between 0.05 mm and 0.15 mm.

11. The wig or hairpiece of claim 1, wherein the thin drawable film one of partially coats and totally coats the surface of the drawable fabric.

12. A wig or hairpiece having a flexible antislip system which allows a user to non-adhesively and removably attach the wig or hairpiece to a user's head, comprising:

an elastically deformable fabric core impregnated with a plurality of thin flexible film strips;

each of the thin flexible film strips being arranged on a surface of the fabric core which contacts the skin of a user's head when the wig or hairpiece is positioned on a user's head; and each of the thin flexible film strips preventing the wig or hairpiece from slipping on a user's head when positioned on a user's head, wherein each of the thin flexible film strips has at least one of a non-sticky and a non-gummy antislip surface at temperatures lower than a softening temperature of the thin flexible film strips.

13. The wig or hairpiece of claim 12, wherein each of the thin flexible film strips comprises a flexible antislip strip which prevents the wig or hairpiece from slipping on a user's head when positioned on a user's head.

14. The wig or hairpiece of claim 13, wherein at least one of the flexible antislip strips is arranged along a contour of the elastically deformable fabric core.

15. The wig or hairpiece of claim 13, wherein the flexible antislip strips are arranged in one or more of the following zones of the elastically deformable fabric core; in a frontal zone, in a vertex zone; in at least one temporal zone, and in an occipital zone.

16. The wig or hairpiece of claim 12, further comprising at least one fastening device.

17. The wig or hairpiece of claim 16, wherein the at least one fastening device comprises a flexible antislip band which is arranged in a temporal zone of the elastically deformable fabric core.

18. The wig or hairpiece of claim 12, wherein each of the thin flexible film strips has a thickness in the range of between 0.05 mm and 0.15 mm.

19. A wig or hairpiece having a flexible antislip system which allows a user to non-adhesively and removably attach the wig or hairpiece to a user's head, comprising:

a cap made of a fabric impregnated with a plurality of thin flexible antislip film strips;

each of the thin flexible antislip film strips being arranged on an inner surface of the cap which contacts the skin on a user's head when the wig or hairpiece is positioned on a user's head; and each of the thin flexible antislip film strips preventing the wig or hairpiece from slipping on a user's head when positioned on a user's head, wherein each of the thin flexible antislip film strips has at least one of a non-sticky and a non-gummy antislip surface at temperatures lower than a softening temperature of the thin drawable film strips.

20. The wig or hairpiece of claim 19, wherein each of the thin flexible antislip film strips has a thickness in the range of between 0.05 mm and 0.15 mm.

* * * * *